United States Patent [19]

Schinke

[11] 4,159,764

[45] Jul. 3, 1979

[54] PLASTIC PACKING CONTAINER

[76] Inventor: Friedel Schinke, Hämelingerstrasse 11, 4900 Herford, Fed. Rep. of Germany

[21] Appl. No.: 899,730

[22] Filed: Apr. 25, 1978

[51] Int. Cl.[2] ..... F42B 37/00; F42B 39/00

[52] U.S. Cl. ..... 206/3; 206/583

[58] Field of Search ..... 206/3, 521, 583, 585, 206/591-594; 220/444, 461

[56] References Cited

U.S. PATENT DOCUMENTS

| | | | |
|---|---|---|---|
| 2,356,969 | 8/1944 | Blum | 206/3 |
| 2,721,652 | 10/1955 | Lyon | 206/3 |
| 2,722,307 | 11/1955 | Burke et al. | 206/3 |
| 2,903,124 | 9/1959 | Carver | 206/3 |
| 3,072,022 | 1/1963 | Wood et al. | 206/3 |
| 3,487,921 | 1/1970 | Barth et al. | 206/583 |

FOREIGN PATENT DOCUMENTS

| | | | |
|---|---|---|---|
| 478071 | 1/1938 | United Kingdom | 206/3 |
| 534585 | 3/1941 | United Kingdom | 206/3 |

*Primary Examiner*—Davis T. Moorhead

*Attorney, Agent, or Firm*—Burgess, Ryan and Wayne

[57] ABSTRACT

A plastic packing container for the single packing of goods susceptible to shock, in particular ammunition, wherein the packing container consists of an inner container and an outer container adapted to be closed by a lid, and wherein said outer container is in contact with the inner container in limited areas only so that cavities are formed between the outer container and the inner container, whereby the forces generated upon impact or fall of the loaded plastics packing container, are absorbed by an elastic deformation of the wall portions of the outer container and the inner container which wall portions define the cavities.

12 Claims, 3 Drawing Figures

A-A

B-B

PLASTIC PACKING CONTAINER

FIELD OF THE INVENTION

The invention relates to a packing container made of plastics material for individually packing goods which are susceptible to shock, in particular ammunition, explosive projectiles or the like.

BACKGROUND OF THE INVENTION

Packing containers of the type mentioned above are primarily used for individually packing larger projectiles, such as grenades and the like.

Numerous containers are known for this purpose, such containers consisting of card board, glass fiber reinforced plastics, blow moldable plastics or even wood. Containers of cardboard and wooden boxes are not used anymore in view of the better characteristics of the plastic containers.

Packing containers made of glass fiber reinforced plastics have the advantage that the inherent hardness by which these materials are characterized permits wide savings in that the walls of the packing containers can be made thin. Yet improvements in the shaping of the packing containers in order to adapt such containers to the respective goods to be packed can only be achieved within certain limits because of the process of manufacture of such containers which process is determined by the material used. Therefore, the packing containers of glass fiber reinforced material have a simple round or angular shape of the kind of a tube, and has to be fitted with special damping inserts for protecting their respective contents. Thus normally felt or soft rubber strips were placed in the containers in order to center the contents within the tube and, on the other hand, afford some protection against impact. However, as the containers could not be made to any large size but instead corresponded approximately to the size of the grenade to be received these damping strips were relatively thin so that genuine damping was not obtained. Furthermore, these damping or spacing strips could become displaced during transport and thus lose their rather little effect altogether.

The mechanical strength values of the packing container of glass fiber reinforced plastics were to guarantee that the contents would be protected. For this reason the containers were relatively stiff. This in turn caused the disadvantage that the containers, then being stressed by falling or by impact, either could become destroyed or permanently deformed. As there was only little or no damping, the contents could suffer damage as well. Renewed use of the packing container was out of the question.

A container made out of fibrous material is known from the U.S. Pat. No. 2,356,969 to J. J. Blum. The fibrous material of this container consists of a mixture of fibrous pulp and a thermoplastic binder. Although this packing container is designed for the packing, storage and shipment of ammunition, this known container is not safe enough when subjected to shock forces. An impact on the part of this container surrounding the case portion of the shell is transmitted to this case portion substantially undamped. An impact on the outer tubular envelope of this container in the area of the nose portion of the projectile is not sufficiently damped before such impact is transmitted to the projectile. This is because the outer envelope will break when subjected to a point impact because of the material used.

An improvement with respect to the containers mentioned above is a container known from the German published application 1,940,211. This container is made out of a blow moldable thermoplastic material and has damping ribs to support the portion of packed projectile. However, this container consists only of one container envelope so that impact on the packing in various areas of such packing is transmitted directly to the projectile. Considering the fact that not only the nose portion of the projectile is susceptible to shock but also the case portion containing the explosive material, it is highly undesirable to leave any of these portions of the projectile unprotected against impact and shock forces.

In view of the above, the main object of this invention is to design a plastic packing container which provides improved best possible protection of the contents against impact and shock forces acting from outside. It is also an object of the present invention to provide a packing container which permits easier handling and has longer lifetime. It is a further object of the present invention to provide a packing container of plastics material which is shaped to conform with the packed goods so that the packed goods are supported safely.

It is a further object of the present invention to provide a packing container of plastics material adapted to be stacked as desired, where the packed goods may be moved from the container in the stacked condition without disturbing the stack of the containers.

BRIEF DESCRIPTION OF THE INVENTION

In one form, the invention provides a packing container which consists of an inner container and an outer container adapted to be closed by a lid and contacting the inner container in limited areas only such that cavities are formed between the inner container and the outer container to absorbe the forces generated upon impact or fall by an elastic deformation of the wall portions of the inner container and the outer container defining that cavities. In other words, the forces generated upon impact, shock or fall are taken up between the inner container and the outer container and are transmitted to the packed good not at all or only after substantial damping. When a packing container according to the invention is subjected to stress by falling or impact, the walls of the outer and inner containers are deformed in such manner that they can yield elastically into the free hollow spaces.

It proved to be advantageous that the inner container is adapted to the configuration of the article to be received, e.g. an explosive projectile and that the shaft portion of the inner container has a corrugated wall which is a continuous sine wave line as seen in cross section of the packing. This design not only gives the inner container greater rigidity but also permits the wall to deform elastically at first, when subjected to undue load, and then transmit a possible shock to the container content. There is always only point or line contact between the packed article and the inner container. The tip or the delicate part, for instance, of a projectile is protected in addition by a balloon-shaped free space in the front part of the inner container supporting the packed article all around in contactless fashion.

This free space or cavity is deformed elastically like a buffer, i.e. it receives shock elastically upon application of a shock or impact load.

This effect is enhanced still further by a conical cylindrical neck portion provided between the free space or head portion and the shaft portion of the inner container. By virtue of this free space forces acting on the tip are not introduced directly into the shaft portion.

The outer container is formed with stacking faces which permit stacking of the packing containers on top of each other. In cross section of the outer container the stacking faces are to be seen as tangents at the otherwise cylindrical container. Mutual support of the stacking faces is established by integral webs formed so as to interrupt the cylindrical shape of the outer container approximately at angles of 90° with respect to the stacking faces. The stacking faces themselves are furnished with elements preventing relative dislocation within the stack.

The outer container is made stiffer by radial corrugations. At their smallest diameter these corrugations serve to center the inner container and contribute to the elasticity of the outer container in axial direction, in accordance with the respective design and disposition. In a specific embodiment the corrugations may be interrupted by transverse webs in which holes are formed to take up carrying means, such as belts or ropes.

The packing container is closed by a lid provided at its inside with an annular web on which a closed hollow damping ring is preferably snap-fitted. This damping ring in addition absorbs shocks occurring in axial direction.

As the packing is exposed to the most varied temperature conditions, it is possible for a vacuum to become established inside the container, which would make it difficult to open the container. For this reason an air evacuation device is provided in the lid, e.g. in the form of a vent screw.

The lid is attached to the packing container by means of a clamping ring. A bead is provided at the outer container in order not to lose the clamping ring upon opening. The diameter of this bead is so selected that the clamping ring can be closed upon the same without any difficulty and thus be secured against loss on the packing container.

It contributes favorably to the invention that the outer and inner containers are manufactured by an extrusion blow forming process. This process permits the forming of the required shapes, webs, and corrugations without any abrupt steps but instead with soft transitions out of the wall thickness of the blown blank. On the one hand this provides great stability and, on the other hand, optimum elasticity is thus obtained.

BRIEF DESCRIPTION OF THE DRAWINGS

As shown in FIG. 1, the packing container 1 consists of an inner container 2 and an outer container 4 adapted to be closed by a lid 3. The shaft portion 5 of inner container 2 is corrugated, as shown in FIG. 2. Because of this corrugated configuration the contact between outer container 4 and inner container 2 on the one hand and between inner container 2 and the article to be packed, on the other hand, is only along a line or point.

Figure 1:
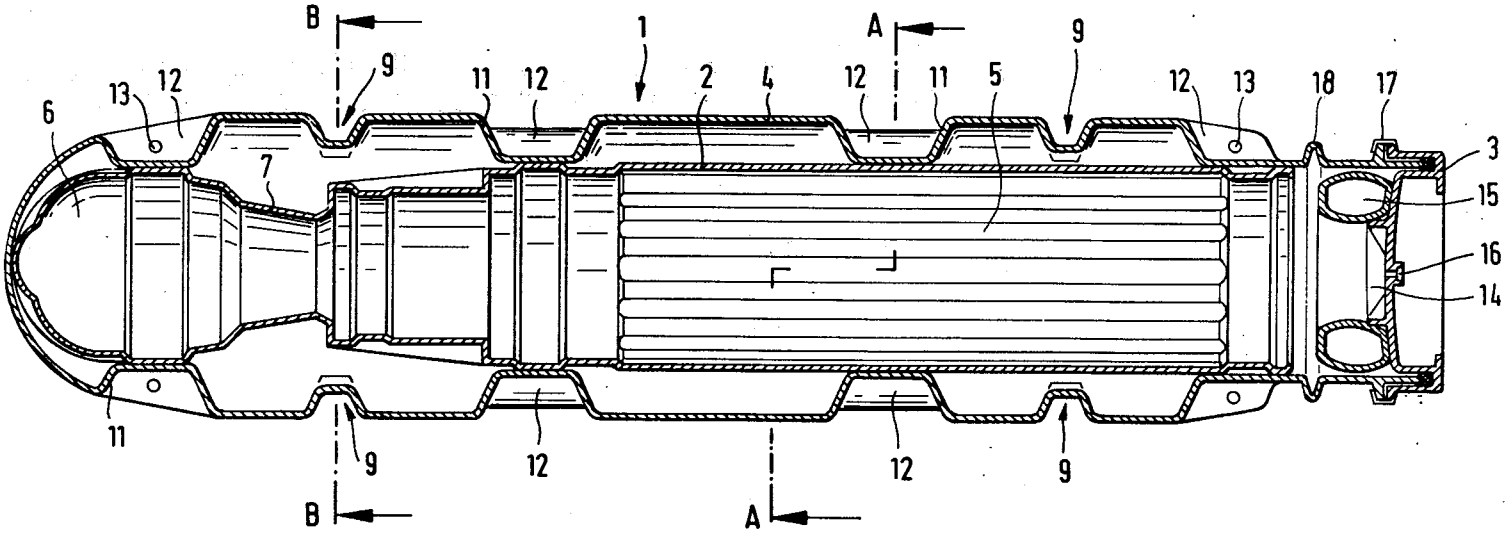
FIG. 1 is a longitudinal sectional elevation of an embodiment of the packing container according to the invention.
Figure 2:
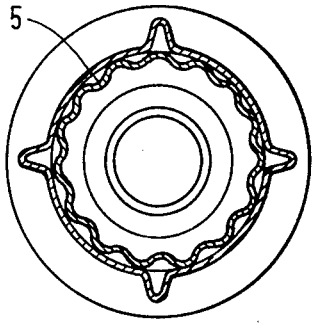
FIG. 2 is a sectional elevation along line A—A of FIG. 1.

It is also within the scope of the invention to interrupt the wave form in longitudinal direction of the packing so that the contact is limited still further or the cavities are enlarged. The inner container 2 has a balloon-shaped free space 6 which communicates with shaft portion 5 through a conical cylindrical neck portion 7. In a specific development of the invention the neck portion 7 may be conical in opposed direction so as to serve for centering for instance the tip of a projectile, yet without giving up the advantages of the invention.

The inner diameter of outer container 4 is so much greater than the outer diameter of inner container 2 that hollow space remains between the two. The hollow space is interrupted in places only, preferably in the area of corrugations 11 which are directed inwardly from the outer container 4 and center the inner container 2. Further contact between inner container 2 and outer container 4 is established close to the opening. Thus the wall portions which define the cavity interrupted by the corrugations 11 can yield elastically when stressed by shock, without hitting each other.

Figure 3:
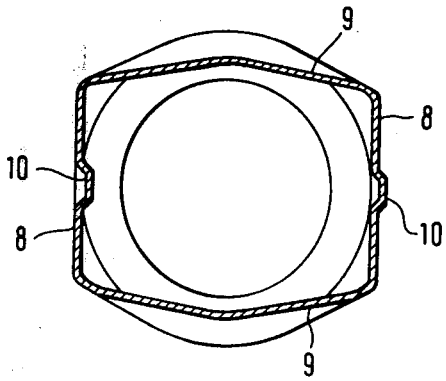
FIG. 3 is a sectional elevation along line B—B of FIG. 1.

As shown in FIG. 3, outer container 4 is provided with stacking faces 8 formed in the blowing process out of the otherwise cylindrical wall of outer container 4. It is advantageous to interconnect the stacking faces 8 by means of reinforcing webs 9 in order to obtain mutual support of the stacking faces. The otherwise cylindrical wall of the outer container is interrupted also at the locations of those webs. Stacking elements 10 introduced in stacking faces 8 prevent dislocation of the stacked containers.

The design in accordance with the invention, of the outer container 4 being adapted to the outer dimension of inner container 2 in the area of the opening, provides another advantage. The stacking height of the packing container and the smaller opening of outer container 4 disposed centrally opposite the same affords free space in the area of the lid between the packing containers in the composite stack. This free space makes it possible to open individual containers in the stack without having to observe a certain sequence.

It may be advantageous to interrupt the corrugations 11 by transverse webs 12. One or more of the transverse webs 12 may then be provided with holes 13 which may be used to receive carrying means.

As shown in FIG. 1, the lid 3 of packing container 1 may be of the kind to be pushed on. It is provided at its inside with an angular web element 14 on which a damping ring 15 may be snap-fitted, shrunk or cemented. Preferably this damping ring 15 is manufactured by a blow forming process and dampens shocks in axial direction. For evacuation purposes lid 3 is provided with an air venting means, preferably a vent screw with seal.

Lid 3 is connected with outer container 4 by means of a clamping ring 17. When lid 3 is taken off, clamping ring 17 may be fixed on an additional bead 18 at the outer container 4 so as to be secured against loss on packing container 1.

Axial displacement of inner container 2 with respect to outer container 4 is prevented by virtue of the fact that the wall portion of inner container 2 surrounding the free space 6 engages the tip of outer container 4 from the inside and that the opening of inner container 2 engages damping ring 15 along a collar. Any tolerances in length of the packed articles are compensated by intermediate layers.

It proved to be particularly advantageous if the outer container and the inner container of packing container 1 are manufactured by an extrusion blow forming process because that makes it possible to guarantee smooth transitions between all wall portions. This is a condition for the stability and for the required elasticity of the packing container according to the invention.

It is another advantage that even with part of the container, for example the outer container, destructed, the inner container still is useful as an emergency packing. And there is no reason why it should not be used again. It is also conceivable to use the inner container alone if the goods to be received are not so heavy and sensible. In that case, it is mainly the free space 6 which is relied upon for shock absorbence. It is a matter of course that in such an event the inner container must be provided with a separate lid.

The invention consequently is not limited to the embodiment shown and described but may be modified in accordance with the invention. This applies above all to the shape of the packing container which, of course, may have other geometric configurations in response to the respective contents without leaving the scope of the invention.

What is claimed is:

1. A plastic packing container for individually packing goods susceptible to shock, the packing container comprising an inner container and an outer container, said outer container being provided with closure means, said inner container being adapted to the outer shape of the goods to be packed, said inner and said outer container comprising an elastically deformable plastic material, said outer container having a sustantially larger diameter than the outer diameter of the inner container and having corrugations forming wall portions to support the inner container such that said inner container is essentially surrounded by cavities formed by wall portions of said inner container and said outer container, so that a local support in only restricted areas is formed between said inner container and said outer container whereby the forces generated upon impact or fall are absorbed by an elastic deformation of the walls defining said cavities.

2. A packing container as claimed in claim 1, wherein a shaft portion of the inner container is corrugated so that, in this area, a line or point contact only is established between the packed article and the inner container.

3. A packing container as claimed in claim 1, wherein the inner container is provided with a balloon-shaped portion within which the tip of the packed article, for instance the tip of a projectile, ends when the article to be packed is inserted into the inner container.

4. A packing container as claimed in claim 1, wherein that inner container comprises a conical cylindrical neck portion between a shaft portion of the inner container and a balloon-shaped portion for housing the tip of an article to be packed.

5. A packing container as claimed in claim 1, wherein said outer container is provided with radial corrugations.

6. A packing container as claimed in claim 5, wherein the corrugations are reinforced by transverse webs, the inner surface defined by said webs serving to center said inner containers.

7. A packing container as claimed in claim 6, wherein the transverse webs are provided with holes to receive carrying means.

8. A packing container as claimed in claim 1, wherein said closure means is a lid of said outer container, and wherein said lid is provided at its inside with an angular web of such outline that a preferably hollow closed damping ring can be snap-fitted, shrunk or cemented on said web.

9. A packing container as claimed in claim 1, wherein said closure means is a lid of that outer container, and wherein said lid comprises an air evacuation device known per se in its lid surface.

10. A packing container as claimed in claim 1, wherein said closure means is a lid of said outer container, and wherein said lid is connected to said outer container by means of a clamping ring, and wherein a bead is provided upon the outer container to receive said clamping ring when said lid is removed.

11. A packing container as claimed in claim 1, characterized in that said outer container is provided with stacking faces which are supported mutually by tangential webs, and wherein elements preventing dislocation of the stacked containers to each other are arranged on said stacking faces.

12. A packing container as claimed in claim 1, characterized in, that said inner container and said outer container consist of an extrusion blow moldable material.

* * * * *